US005820090A

United States Patent [19]

Nickels

[11] Patent Number: 5,820,090

[45] Date of Patent: Oct. 13, 1998

[54] PAINT LADEN PAINT BRUSH HOLDER

[76] Inventor: William A. Nickels, 126 Jackson St., Philadelphia, Pa. 19148

[21] Appl. No.: 825,905

[22] Filed: Apr. 2, 1997

[51] Int. Cl.[6] ..... A47B 96/06

[52] U.S. Cl. ..... 248/213.2; 248/205.3; 220/251

[58] Field of Search ..... 248/311.2, 205.3, 248/220.21, 312.1, 315, 213.2; 224/251, 901, 148.4; 220/694, 697, 699, 735, 737

[56] References Cited

U.S. PATENT DOCUMENTS

| | | | |
|---|---|---|---|
| D. 346,054 | 4/1994 | Spangler | D32/54 |
| D. 353,920 | 12/1994 | Daiker | D32/54 |
| 3,462,109 | 8/1969 | Forbes | 248/311.2 |
| 5,007,553 | 4/1991 | Curtis | 220/90 |
| 5,074,506 | 12/1991 | Larsen | 248/311.2 |
| 5,178,354 | 1/1993 | Engvall | 248/205.3 |
| 5,301,799 | 4/1994 | Gurba, Jr. | 206/1.7 |
| 5,375,736 | 12/1994 | Gonzalez et al. | 220/697 |
| 5,474,273 | 12/1995 | Vinal | 248/311.2 |
| 5,626,318 | 5/1997 | Boettger et al. | 248/311.2 |

*Primary Examiner*—Ramon O. Ramirez
*Assistant Examiner*—Willie Berry, Jr.
*Attorney, Agent, or Firm*—Richard L. Miller, P.E.

[57] ABSTRACT

A paint laden paint brush holder that is replaceably securable to an outer surface of a paint can and removably receives a cup therein which replaceably receives and holds a paint brush therein. The cup has an open top with a diameter and a closed bottom with a diameter that is less than the diameter of the open top of the cup. The holder includes a ring, a post, and securing apparatus. The ring has an outer periphery and a diameter and removably holds the cup therein. The post is fixedly secured to the ring. And, the securing apparatus replaceably secures the paint laden paint brush holder to the outer surface of the paint can.

1 Claim, 1 Drawing Sheet

PAINT LADEN PAINT BRUSH HOLDER

BACKGROUND OF THE INVENTION

1. Field of the Invention

The present invention relates to a paint brush holder. More particularly, the present invention relates to a paint laden paint brush holder that is replaceably attachable to the side of a paint can and having the ability to removably receive a receptacle that replaceably receives a paint brush.

2. Description of the Prior Art

During painting, the process is interrupted periodically to perform supporting tasks such as moving equipment or ladders, covering surrounding objects or areas, or to perform tasks such as edge masking or the like. During these interruptions, the painter needs to rest the paint brush at some convenient location.

This need to periodically rest the paintbrush upon a convenient surface or container can, however, become a problem as a result of the quantity of paint which remains upon portions of the paintbrush bristles or hairs raising the possibility of contamination of the brush from some dirt laden surfaces not intended to be painted. Thus, a genuine problem arises in providing such a convenient resting place.

Numerous innovations for a paint brush have been provided in the prior art that will be described. Even though these innovations may be suitable for the specific individual purposes to which they address, however, they differ from the present invention in that they do not teach a paint laden paint brush holder that is replaceably attachable to the side of a paint can and having the ability to removably receive a receptacle that replaceably receives a paint brush.

FOR EXAMPLE, U.S. Pat. No. Des. 346,054 to Spangler teaches the ornamental design for a paint can supported brush holder.

ANOTHER EXAMPLE, U.S. Pat. No. Des. 353,920 to Daiker teaches the ornamental design for a brush holder for a paint can.

STILL ANOTHER EXAMPLE, U.S. Pat. No. 5,007,553 to Curtis teaches a container for a paint brush which comprises a body and a lid. The body has a base and a walled portion which upstands from the base. The lid has an aperture through which a handle of the paint brush passes and slits which extend from the aperture and which enables parts of the lid defining the aperture to grip the handle of the paint brush. The walled portion of the body has an inwardly projecting integrally formed shelf portion on which to rest the paint brush. Integrally formed ribs extend parallel to the base for wiping excess paint from the paint brush.

YET ANOTHER EXAMPLE, U.S. Pat. No. 5,301,799 to Gurba, Jr. teaches a portable paint brush holder having a hollow cylindrical main body with two open ends. A rubber stopper is inserted into one end to act as a base for the device. A plurality of variably sized apertures are formed in the rubber stopper to provide support for a plurality of brushes of different sizes. A flexible cap having square outer dimensions is adapted to fit snugly over the other end. The square outer dimensions of the cap serve to prevent rolling of the device when it is laced on an inclined surface.

STILL YET ANOTHER EXAMPLE, U.S. Pat. No. 5,375,736 to Gonzalez et al. teaches a paintbrush holder that includes a horizontal portion supporting a resilient edge attachment securable to a variety of paint can configurations. An upwardly angled portion extends from the horizontal portion and terminates in a concave upwardly facing notch having extending prongs on either side thereof. A triangularly shaped portion extends from the horizontal portion and terminates in a straight edge useful for paint masking. The brush holder further includes an upwardly extending tab used in retaining or securing a paintbrush rested upon the paintbrush holder such that the paintbrush handle is received within the upwardly facing concave notch while the paintbrush bristle portion rests upon and extends downwardly from the triangle extension.

It is apparent that numerous innovations for paint brush holders have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a paint laden paint brush holder that avoids the disadvantages of the prior art.

ANOTHER OBJECT of the present invention is to provide a paint laden paint brush holder that is simple and inexpensive to manufacture.

STILL ANOTHER OBJECT of the present invention is to provide a paint laden paint brush holder that is simple to use.

BRIEFLY STATED, YET ANOTHER OBJECT of the present invention is to provide a paint laden paint brush holder that is replaceably securable to an outer surface of a paint can and removably receives a cup therein which replaceably receives and holds a paint brush therein. The cup has an open top with a diameter and a closed bottom with a diameter that is less than the diameter of the open top of the cup. The holder includes a ring, a post, and securing apparatus. The ring has an outer periphery and a diameter and removably holds the cup therein. The post is fixedly secured to the ring. And, the securing apparatus replaceably secures the paint laden paint brush holder to the outer surface of the paint can.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures on the drawing are briefly described as follows.

LIST OF REFERENCE NUMERALS UTILIZED IN THE DRAWING

Figure 3:
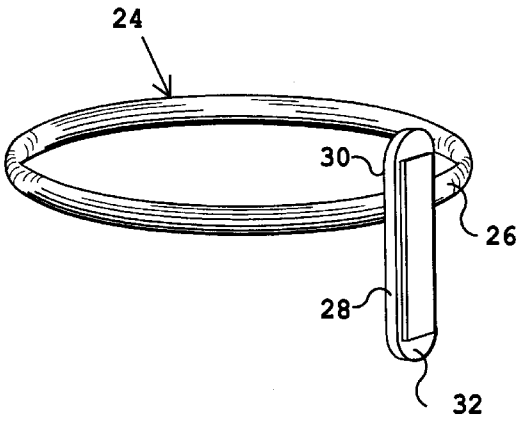
FIG. 3 is an enlarged diagrammatic perspective view of the present invention.

10 paint laden paint brush holder of the present invention
12 paint can outer surface

14 paint can
16 cup
18 paint brush
20 cup open top
22 cup closed bottom
24 ring
26 ring outer periphery
28 post
30 post first face
32 post second face
34 portion of two-sided tape

DETAILED DESCRIPTION OF THE PREFERRED EMBODIMENT

Figure 1:
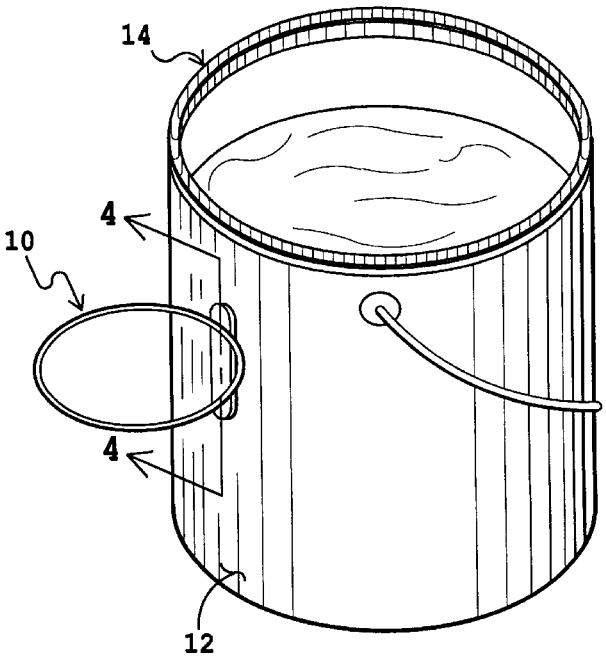
FIG. 1 is a diagrammatic perspective view of the present invention replaceably secured to a typical paint can.
Figure 2:
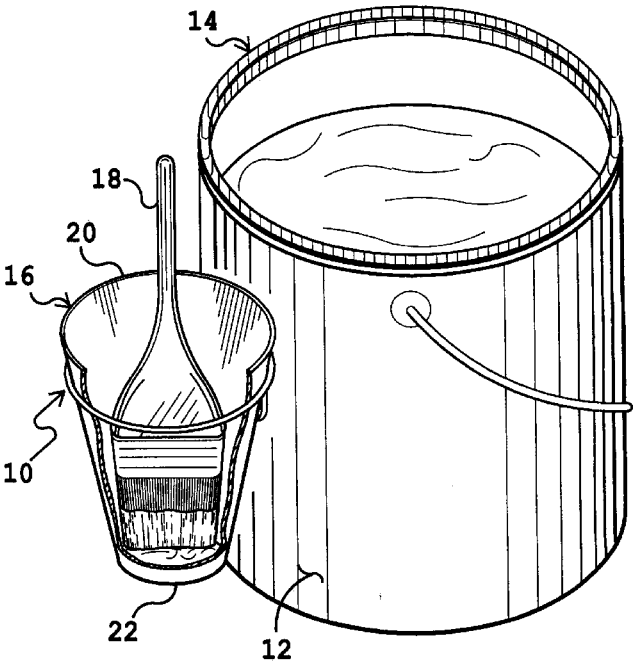
FIG. 2 is a diagrammatic perspective view of the present invention replaceably secured to the typical paint can as shown in FIG. 1 and having a cup with parts thereof broken away removably mounted therein that replaceably receives a paint brush therein.

Referring now to the figures in which like numerals indicate like parts, and particularly to FIGS. 1 and 2, the paint laden paint brush holder of the present invention is shown generally at 10 replaceably secured to a paint can outer surface 12 of a paint can 14 and removably receiving a cup 16 therein that replaceably receives and holds a paint brush 18 therein.

The cup has a cup open top 20 with a diameter and a cup closed bottom 22 with a diameter that is less than the diameter of the cup open top 22 of the cup 16.

Figure 4:
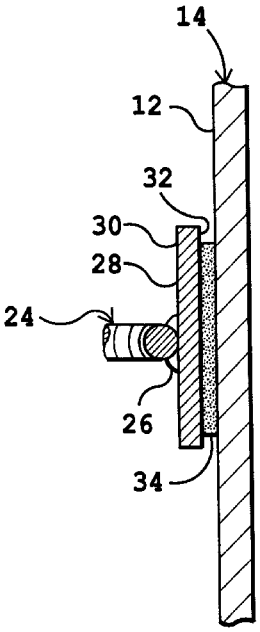
FIG. 4 is an enlarged cross sectional view taken along line 4—4 in FIG. 1.

The configuration of the paint laden paint brush holder 10 can best be seen in FIGS. 3 and 4, and as such will be discussed with reference thereto.

The paint laden paint brush holder 10 includes a ring 24 that is horizontally-oriented and has a ring outer periphery 26 and a diameter that is less than the diameter of the cup open top 20 of the cup 16 but greater than the diameter of the cup closed bottom 22 of the cup 16 so as to allow the cup 16 to be inserted therein without falling therethrough while being removably held therein.

The paint laden paint brush holder 10 further includes a post 28 that is vertically-oriented, flat, generally rectangular-shaped, and has rounded upper and lower ends to eliminate sharps edges thereat.

The post 28 has a post first face 30 that is fixedly secured to the ring outer periphery 26 of the ring 24 and extends perpendicularly upwardly and downwardly therefrom. The post first face 30 of the post 28 can be fixedly secured to the ring outer periphery 26 of the ring 24 by any suitable means. The post 28 further has a post second face 32 that is opposite the post first face 30 of the post 28.

The paint laden paint brush holder 10 further includes a portion of two-sided tape 34 having a first side thereof removably affixed to the post second face 32 of the post 28 and a second side thereof removably affixable to the paint can outer surface 12 of the paint can 14 so as to allow the paint laden paint brush holder 10 to be removably secured to the paint can 14.

It will be understood that each of the elements described above, or two or more together, may also find a useful application in other types of constructions differing from the types described above.

While the invention has been illustrated and described as embodied in a paint laden paint brush holder, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A paint laden paint brush holder for replaceably securing to an outer surface of a paint can and for removably receiving a cup therein which is for replaceably receiving and holding a paint brush therein, wherein the cup has an open top with a diameter and a closed bottom with a diameter that is less than the diameter of the open top of the cup, said holder comprising:

a) ring having an outer periphery and a diameter and being for removably holding the cup therein:

b) a post being fixedly secured to said ring for replaceably securing to the outer surface of the paint can; said post being flat and generally rectangular-shaped; said post having rounded upper and lower ends for eliminating sharps edges thereat; said post further having a first face fixedly secured to said outer periphery of said ring and extending perpendicularly upwardly and downwardly therefrom and a second face being opposite said first face of said post; and c) securing means for replaceably securing said paint laden paint brush holder to the outer surface of the paint can; said securing means including a portion of two-sided tape having a first side removably affixed to said second face of said post and a second side for removably affixing to the outer surface of the paint can.

* * * * *